United States Patent [19]

Monden

[11] Patent Number: 5,031,597

[45] Date of Patent: Jul. 16, 1991

[54] FUEL INJECTION CONTROL SYSTEM FOR AN AUTOMOTIVE ENGINE

[75] Inventor: Hitoshi Monden, Tokyo, Japan

[73] Assignee: Fuji Jukogyo Kabushiki Kaisha, Tokyo, Japan

[21] Appl. No.: 475,463

[22] Filed: Feb. 2, 1990

[30] Foreign Application Priority Data

Feb. 28, 1989 [JP] Japan ..... 1-048146

[51] Int. Cl.[5] ..... F02M 51/00

[52] U.S. Cl. ..... 123/492

[58] Field of Search ..... 123/492, 435, 489, 493, 123/440, 480, 488; 364/431.07

[56] References Cited

U.S. PATENT DOCUMENTS 4,805,577 2/1989 Kanno et al. ..... 123/488
4,852,538 8/1989 Nagaishi ..... 123/492
4,858,136 8/1989 Tanaka et al. ..... 364/431.07
4,887,575 12/1989 Takahashi ..... 123/435
4,896,644 1/1990 Kato ..... 123/492

FOREIGN PATENT DOCUMENTS 61-126337 6/1986 Japan .

*Primary Examiner*—Raymond A. Nelli
*Attorney, Agent, or Firm*—Martin A. Farber

[57] ABSTRACT

A fuel evaporation quantity is estimated based on engine speed and opening degree of a throttle valve. The quantity of fuel to be injected is provided based on the estimated fuel evaporation quantity. A weight for a weighted mean is changed in accordance with the engine operating condition. A smoothed fuel injection quantity is provided by the weighted mean with the weight.

8 Claims, 4 Drawing Sheets

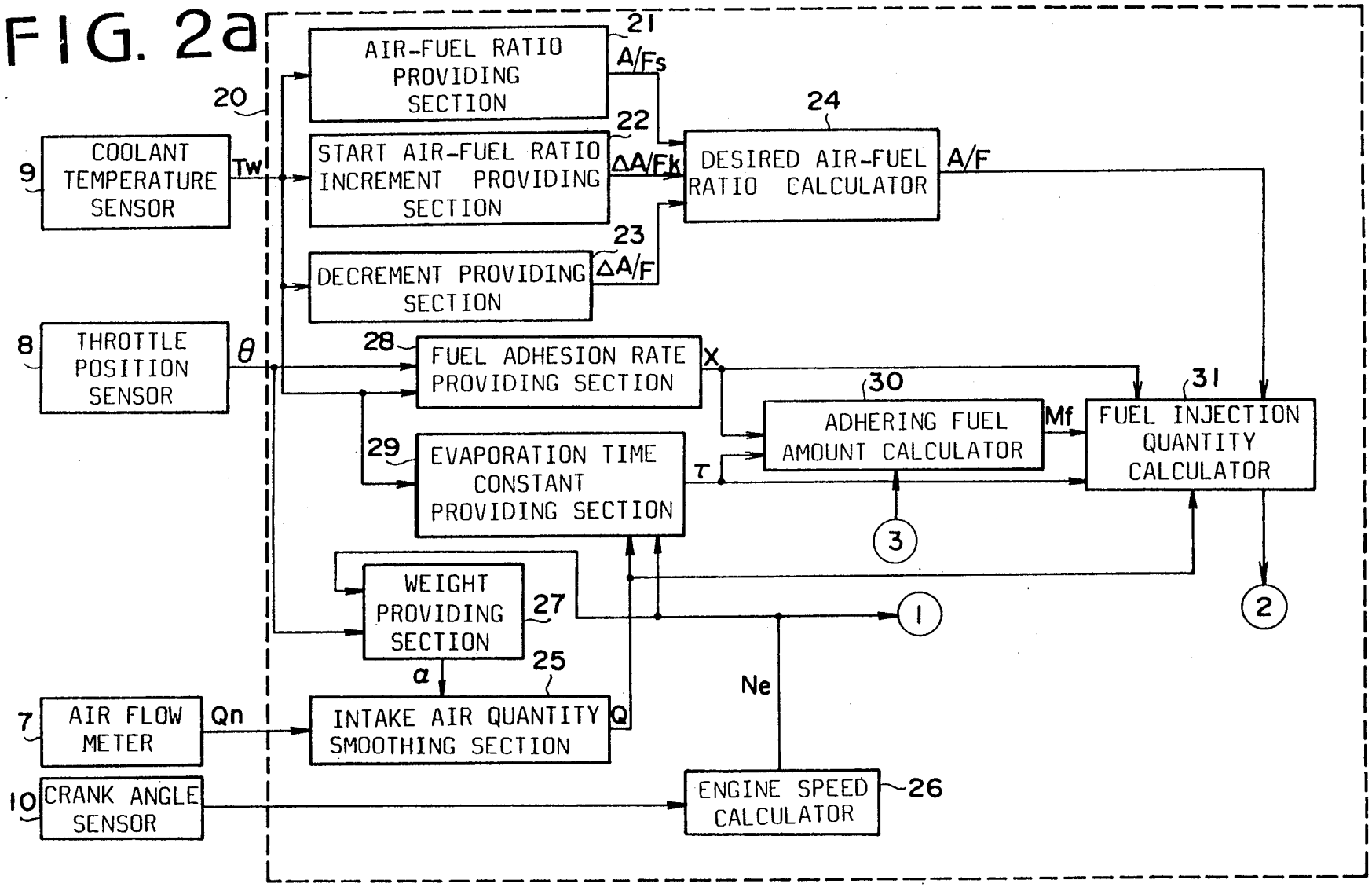
FIG. 2a
AIR-FUEL RATIO PROVIDING SECTION
START AIR-FUEL RATIO INCREMENT PROVIDING SECTION
DECREMENT PROVIDING SECTION
DESIRED AIR-FUEL RATIO CALCULATOR
FUEL ADHESION RATE PROVIDING SECTION
EVAPORATION TIME CONSTANT PROVIDING SECTION
ADHERING FUEL AMOUNT CALCULATOR
FUEL INJECTION QUANTITY CALCULATOR
WEIGHT PROVIDING SECTION
INTAKE AIR QUANTITY SMOOTHING SECTION
ENGINE SPEED CALCULATOR
COOLANT TEMPERATURE SENSOR
THROTTLE POSITION SENSOR
AIR FLOW METER
CRANK ANGLE SENSOR
A/Fs
ΔA/Fk
ΔA/F
A/F
X
τ
Mf
Ne
Tw
θ
Qn
Q
α
20
21
22
23
24
25
26
27
28
29
30
31
1
2
3
7
8
9
10

FUEL INJECTION CONTROL SYSTEM FOR AN AUTOMOTIVE ENGINE

BACKGROUND OF THE INVENTION

The present invention relates to a system and method for controlling fuel injection in an automotive engine having a single point injector, and more particularly to the system and method for controlling the quantity of fuel to be injected in accordance with a transport model of the fuel.

In a fuel injection system provided with a single fuel injector in a throttle body provided in an intake passage, injected fuel is induced in cylinders of the engine through the intake passage. A part of the fuel passing through the intake passage adheres to the wall of the passage to form a fuel film thereon. The fuel adhered to the wall eventually evaporates and is induced in the cylinders together with the injected fuel, which causes a difference between the quantity of the injected fuel calculated in dependency on engine operating conditions and the quantity actually induced in the cylinders of the engine. In order to control the actual quantity induced in the cylinders to a desired quantity, a fuel injection system has been proposed where the amount of fuel adhered to the wall of the intake passage and the rate of evaporating fuel thereof are estimated based on the fuel transport model to correct the quantity of fuel to be injected. Japanese Patent Laid-Open No. 61-126337 discloses a fuel injection system where a fuel injection quantity Gf is calculated based on a desired fuel quantity Qa/(A/F), a quantity of evaporated fuel $Mf/\tau$, a rate $(1-x)$ of the quantity of fuel induced into the cylinders of the engine without adhering to the wall of the intake passage.

The prior art discloses a system for providing only a basic fuel injection quantity. Since there are various noise sources such as a spark plug in an engine compartment, the output signals of various sensors such as an engine speed sensor and a throttle position sensor can be affected by the noises. Consequently, the fuel injection quantity which is calculated based on engine speed and a throttle position is miscalculated, and hence, in particular in an engine with a single point injector, the fuel injection quantity oscillates, which causes deterioration of emission control and driveability.

To solve such a problem, the calculated fuel injection quantity should be filtered, for example by performing a weighted mean method. However, if a weight is constant regardless of the engine operating condition, the response of the engine speed in a transient state is delayed.

SUMMARY OF THE INVENTION

The object of the present invention is to provide a fuel injection control system wherein the fuel injection quantity is corrected by changing the weight in a weighted mean method, thereby preventing oscillation of the fuel injection quantity while maintaining a good response in a transient state.

The other objects and features of this invention will become understood from the following description with reference to the accompanying drawings.

BRIEF DESCRIPTION OF DRAWINGS

FIGS. 2*a* and 2*b* show a block diagram of the system of the present invention.

DETAILED DESCRIPTION OF THE PREFERRED EMBODIMENT

Figure 1:
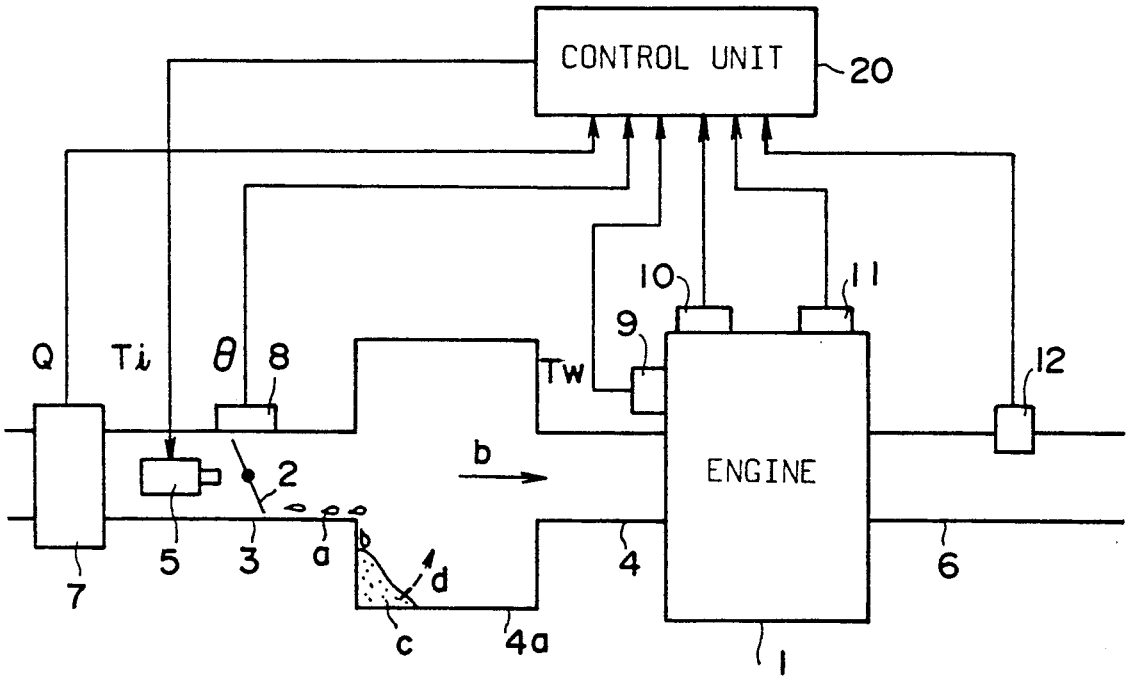
FIG. 1 is a schematic diagram showing a system according to the present invention.

Referring to FIG. 1, an automotive engine 1 for a motor vehicle has a throttle valve 2 provided in a throttle body 3 communicated with an intake pipe 4. A single point fuel injector 5 is provided in the throttle body 3 upstream of the throttle valve 2 so as to supply fuel to each cylinder of the engine 1. An air flow meter 7 is provided upstream of the injector 5. A throttle position sensor 8 is provided on the throttle valve 2. A crank angle sensor 10 and a cam angle sensor 11 are provided on the engine 1 and a coolant temperature sensor 9 is mounted in a water jacket (not shown). An $O_2$-sensor 12 is provided in an exhaust pipe 6 of the engine 1. Output signals of these sensors for detecting respective conditions are applied to a control unit 20 comprising a microcomputer to operate the fuel injector 5.

In the intake system, fuel A injected from the injector 5 and mixed with air is induced in the cylinders of the engine 1 through the intake pipe 4. However, a part of the injected fuel A adheres to the wall of the intake pipe 4, thereby forming a film C of the fuel, for example at a corner of a throttle chamber 4*a* formed at the intake pipe 4. The fuel consisting of the film C is eventually vaporized so that evaporation fuel D is supplied to the cylinders of the engine 1 with the air.

The calculation of a fuel injection quantity based on a fuel transport model is described hereinafter. If the fuel injection quantity is Gf, a fuel adhesion rate is x, an amount of the adhering fuel is Mf, and a time constant of the evaporation of the adhering fuel is $\tau$, a changing rate dMf/dt of the quantity of fuel accumulated on the walls is the difference between an amount of the adhering fuel (x·Gf) and an evaporation quantity $Mf/\tau$, that is $$dMf/dt = x \cdot Gf - Mf/\tau \quad (1)$$

On the other hand, a quantity of floating fuel B which does not adhere to the wall of the intake passage is expressed as $(1-x)Gf$. Since a transport fuel consisting of the floating fuel B and the evaporated fuel is induced in the cylinders, a quantity Ge of the actually induced fuel is $$Ge = (1-x)Gf + Mf/\tau \quad (2)$$

Therefore, the quantity Gf is $$Gf = (Ge - Mf/\tau)/(1-x)$$

Since the fuel quantity Ge actually supplied is regarded as a desired fuel injection quantity dependent on a desired air-fuel ratio A/F and an intake air quantity Q, it is represented as $$Ge = Q/(A/F)$$

The above equation can be expressed as follows.

$$Gf=\{Q/(A/F)-Mf/\tau\}(1-x) \quad (3)$$

The fuel injection quantity Gf can thus be calculated based on the desired fuel injection quantity Q/(A/F), the evaporation quantity Mf/$\tau$ and a rate (1−x) of fuel which does not adhere to the walls of the intake pipe 4.

Figure 2B:
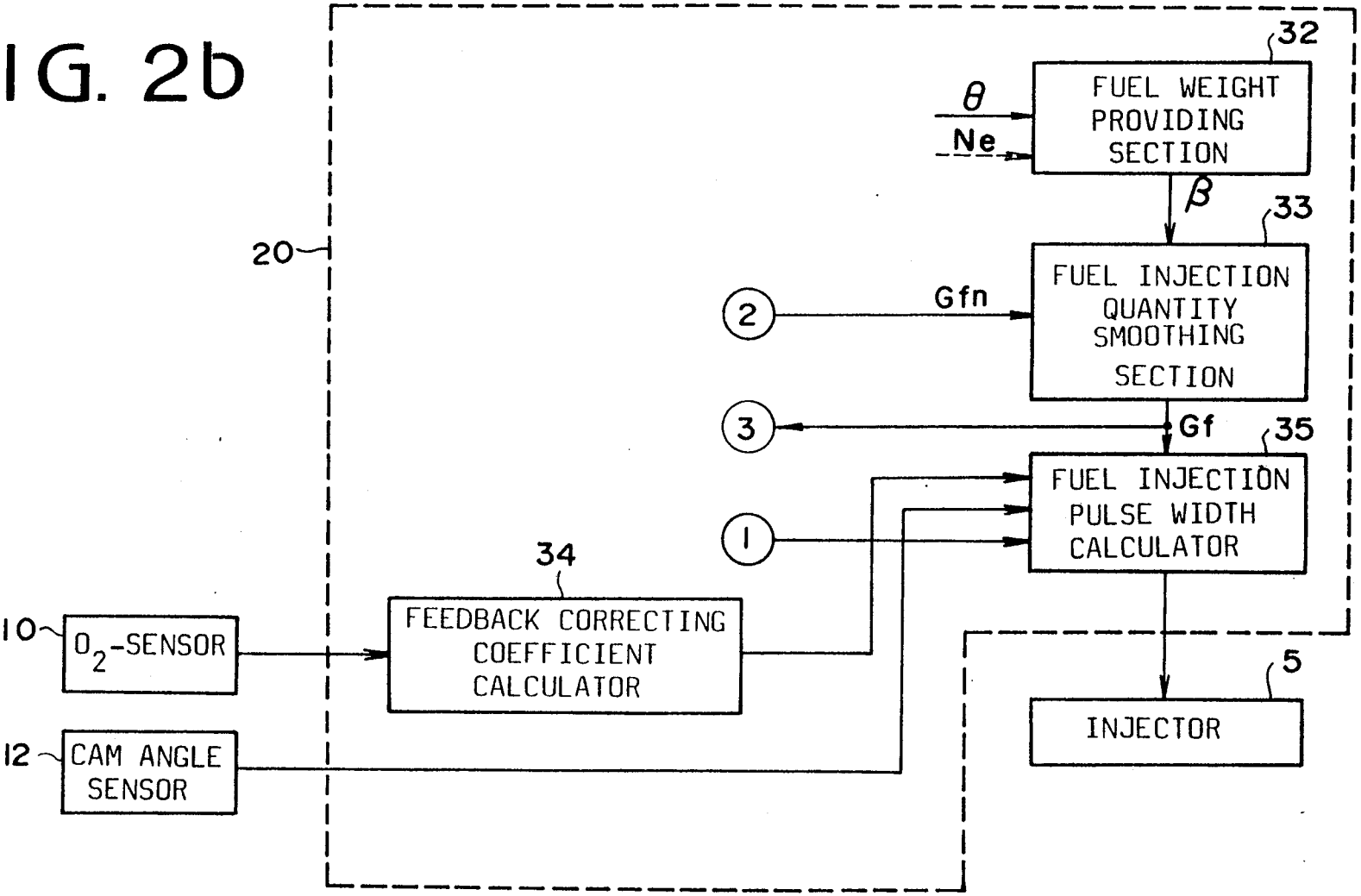

Referring to FIGS. 2*a*, 2*b* the control unit 20 of the present invention comprises an air-fuel ratio providing section 21, a start air-fuel ratio increment providing section 22 and a decrement providing section 23, each of which has a lookup table and is applied with a coolant temperature Tw from the coolant temperature sensor 9. In accordance with the coolant temperature Tw, the air-fuel ratio providing section 21 provides an air-fuel ratio A/Fs for driving the motor vehicle, the start air-fuel ratio increment providing section 22 provides an air-fuel ratio increment ΔA/Fk for starting the engine, and the decrement providing section 23 provides an air-fuel ratio decrement ΔA/F for decreasing the air-fuel ratio in accordance with the evaporation of the adhered fuel. Outputs of the sections 21, 22 and 23 are applied to a desired air-fuel ratio calculator 24 where a desired air-fuel ratio A/F is calculated as follows.

$$A/F=A/Fs-\Delta A/Fk+\Delta A/F$$

The control unit 20 has an intake air quantity smoothing section 25 and an air flow weight providing section 27. The weight providing section 27 has a lookup table and is applied with a throttle valve opening degree $\theta$ from the throttle position sensor 8 and an engine speed Ne calculated at an engine speed calculator 26 based on a crank angle signal from the crank angle sensor 10. An air flow weight $\alpha$ for a weighted mean derived from the lookup table in accordance with the engine speed Ne and the opening degree $\theta$ is fed to the intake air quantity smoothing section 25 to calculate the weighted mean of the intake air quantity as follows.

$$Q=(1/\alpha)Qn+\{(\alpha-1)/\alpha\}Qo$$

where Qn is an intake air quantity detected by the air flow meter 7 and Qo is an intake air quantity calculated in the smoothing section 25 at the last calculation.

The control unit 20 is further provided with a fuel adhesion rate providing section 28 having a lookup table and an evaporation time constant providing section 29 having a lookup table, which are provided for estimating the variation in quantity of fuel transported through the intake system. The fuel adhesion rate table in the section 28 is a two-dimensional lookup table storing a plurality of adhesion rates x. The adhesion rate is derived in accordance with the throttle valve opening degree $\theta$ and the coolant temperature Tw. On the other hand, the evaporation time constant lookup table in the section 29 is a three-dimensional table storing a plurality of time constants $\tau$ for determining the quantity of fuel evaporated from the fuel film formed on the wall of the intake pipe. Since the fuel evaporation depends not only on the coolant temperature Tw but also on the vacuum in the intake passage which depends on the intake air quantity Q and the engine speed Ne, the evaporation time constant $\tau$ is derived in accordance with the coolant temperature Tw, the intake air quantity Q and the engine speed Ne.

The fuel adhesion rate x and the evaporation time constant $\tau$ are applied to an adhering fuel amount calculator 30. The calculator 30 is also applied with a smoothed fuel injection quantity Gfo calculated in a fuel injection smoothing section 33 at the last calculation. The equation (1) hereinbefore described is modified as set below.

$$(Mfn-Mfo)/\Delta t=x\cdot Gfo-Mfo/\tau$$

where Δt is a calculation interval, Mfn is a present amount of the adhering fuel, Mfo is a amount of the adhering fuel at the last calculation and Gfo is a quantity of the fuel injected at the last injection. Therefore, the present amount Mfn of the adhering fuel is $$Mfn=(1-t/\tau)Mfo+x\cdot\Delta t\cdot Gfo$$

The adhering fuel amount Mf, the fuel adhesion rate x, the evaporation time constant $\tau$ and the desired air-fuel ratio A/F are fed to a fuel injection quantity calculator 31, so that the fuel injection quantity Gfn is calculated as follows in accordance with the equation (3).

$$Gfn=\{Q/(A/F)-Mfo/\tau\}/(1-x)$$

A process for obtaining a weighted mean for suppressing the variation of the fuel injection quantity is described hereinafter. A smoothed fuel injection quantity Gf is obtained by smoothing the fuel injection quantity Gfn of the present calculation and the smoothed fuel injection quantity Gfo of the last calculation in accordance with the weighted mean as follows.

$$Gf=(1/\beta)Gfn+\{(\beta-1)/\beta\}Gfo$$

where $\beta$ is a fuel weight. In a steady state, the fuel weight $\beta$ is set to a large value so that a value of $(\beta-1)/\beta$ becomes larger than a value $1/\beta$. Consequently, a value of $\{(\beta-1)/\beta)\}$ Gfo relative to the fuel injection quantity at the last calculation is highly weighted compared with a value of $(1/\beta)$ Gfn relative to the fuel injection quantity at the present calculation. As a result, even if the present fuel injection quantity Gfn happens to greatly deviate from the previous quantity Gfo, the fluctuation of the fuel injection quantity is restrained. On the other hand, in a transient state, the weight $\beta$ is decreased so that the term $(1/\beta)$Gfn is highly weighted, thereby improving the respondability of the fuel injection system.

To this end, the control unit 20 of the present invention has a weight providing section 32 having a weight lookup table to which the throttle valve opening degree $\theta$ for determining the steady state and the transient state is fed. In the fuel weight providing section 32, four levels $\beta_1$ to $\beta_4$ of fuel weights for the weighted mean, for example, are stored in accordance with a difference $\Delta\theta$ in the throttle valve opening degree $\theta$ during a predetermined period. The difference $\Delta\theta$ is compared with predetermined three reference magnitudes $\Delta\theta_1$, $\Delta\theta_2$, $\Delta\theta_3$, where $\Delta\theta_1<\Delta\theta_2<\Delta\theta_3$. One of the weights $\beta_1$ to $\beta_4$ is derived from the lookup table in accordance with the value of the difference $\Delta\theta$. Namely, when $|\Delta\theta|\leqq\Delta\theta_1$, the fuel weight $\beta_1$ is derived, when $\Delta\theta_1 < |\Delta\theta| \leqq \Delta\theta_2$, the fuel weight $\beta_2$ is obtained, when $\Delta\theta_2 < |\Delta\theta| \leqq \Delta\theta_3$, the fuel weight $\beta_3$ is obtained and when $\Delta\theta_3 < |\Delta\theta|$, the fuel weight $\beta_4$ is obtained.

The values of the fuel weights $\beta_1$ to $\beta_4$ are $\beta_1 > \beta_2 > \beta_3 > \beta_4$. Therefore, in the steady state of the engine where $\Delta\theta$ is smaller than $\Delta\theta_1$, the large weight $\beta_1$ is provided. To the contrary, in the transient state where the difference $\Delta\theta$is larger than $\Delta\theta_3$, the small weight $\beta_4$ is provided.

The fuel weight $\beta$ and the fuel injection quantity Gfn are applied to the fuel injection quantity smoothing section 33 where the averaged fuel injection quantity Gf is calculated in accordance with the above-mentioned equation.

The control unit 20 is further provided with a feedback correcting coefficient calculator 34 where a feedback correcting coefficient $\gamma$ is calculated based on the output signal of the $O_2$-sensor. The feedback coefficient $\gamma$, the smoothed fuel injection quantity Gf and the engine speed Ne are applied to a fuel injection pulse width calculator 35 to calculate a fuel injection pulse width Ti as follows.

$$Ti = K \cdot \gamma \cdot Gf / Ne + Ts$$

where K is a coefficient and Ts is a constant relative to a time lag in the fuel injection system. The output signal of the cam angle sensor 11 is also fed to the fuel injection pulse width calculator 35 for determining a timing to generate the pulse.

The operation of the fuel injection system of the present invention is described hereinafter.

When the engine 1 is operated, the output signals of various sensors are fed to the control unit 20. The desired air-fuel ratio A/F corrected in dependency on the coolant temperature Tw is obtained in the desired air-fuel ratio calculator 24. On the other hand, the smoothed intake air quantity Q is obtained in the intake air quantity smoothing section 25 in accordance with the weighted mean method, where the weight depends on the engine operating conditions. Furthermore, the estimated fuel adhesion rate x and estimated evaporation time constant $\tau$ are derived from the lookup tables of the sections 28, 29, respectively in accordance with the coolant temperature Tw, the engine speed Ne, the throttle valve opening degree $\theta$ and the smoothed intake air quantity Q. In the adhering fuel amount calculator 30, the amount of adhering fuel is estimated based on the quantity Gfo of actually injected fuel, the fuel adhesion rate x and the evaporation time constant $\tau$. The required fuel injection quantity Gfn is calculated in the fuel injection quantity calculator 31 based on the intake air quantity Q, the desired air-fuel ratio A/F, and the evaporation quantity Mfo/$\tau$.

The fuel injection quantity Gfn is further processed in the fuel injection quantity smoothing section 33 in accordance with the weight $\beta$ provided in the weight providing section 32. The smoothed quantity Gf, the engine speed Ne and the feedback correcting coefficient $\gamma$ are applied to the fuel injection pulse width calculator 35 to calculate the pulse width Ti. The injector 5 is operated to inject the fuel at a timing relative to the cam angle. The air-fuel mixture is thus applied to each cylinder of the engine 1 through the intake pipe 4. Since the quantity of fuel which adheres to the walls of the intake pipe and which is vaporized are taken into account of, the actually induced quantity of fuel always coincides with the desired fuel injection quantity Q/(A/F).

Figure 3:
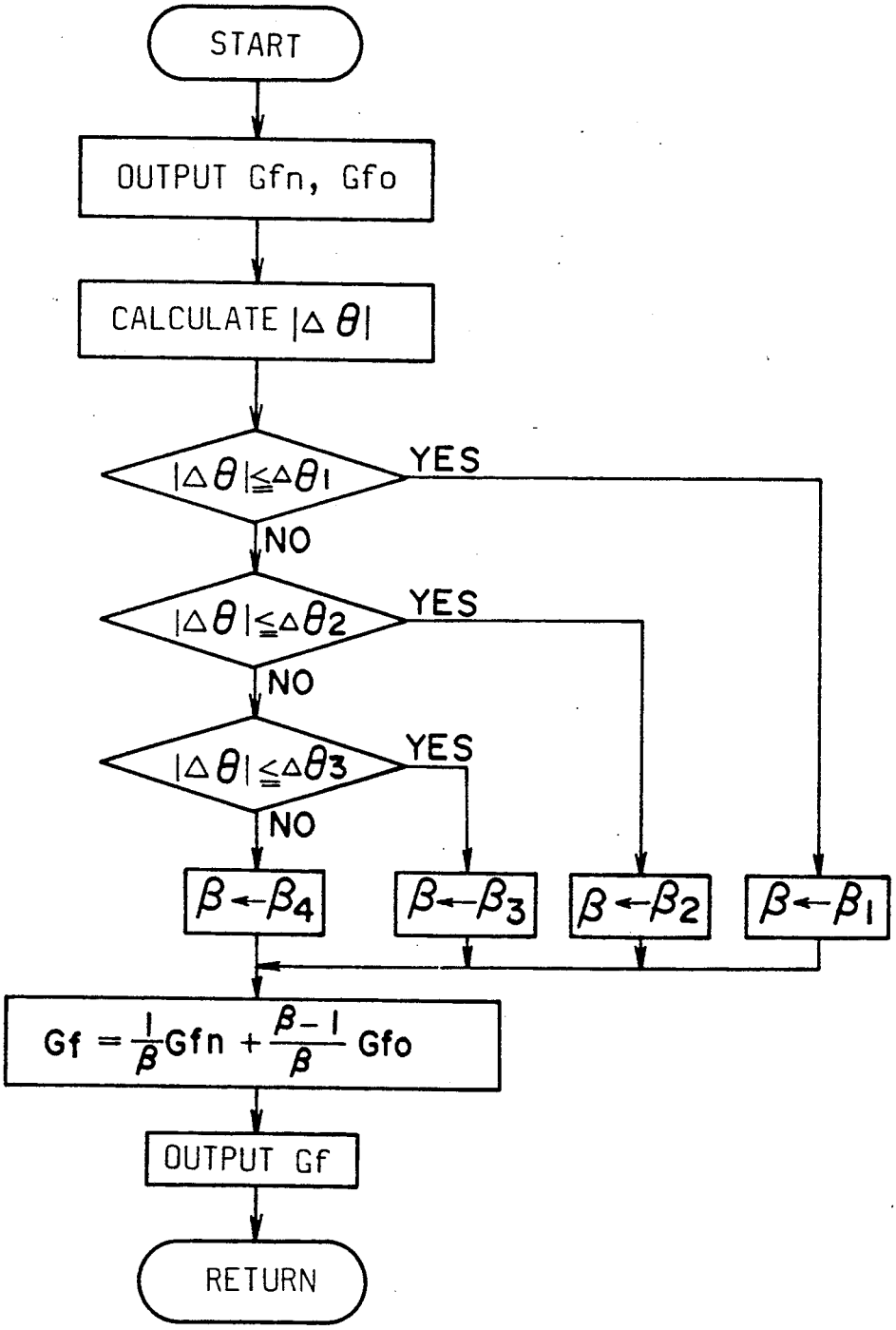
FIG. 3 is a flowchart showing an averaging routine of fuel injection quantities.

The smoothing process of the quantity of fuel to be injected is hereinafter described with reference to FIG. 3.

At the outset, the fuel injection quantity Gfn calculated at the fuel injection quantity calculator 31 and the quantity Gfo obtained in the fuel injection quantity smoothing section 33 at the last routine are obtained. The difference $\Delta\theta$ per predetermined period for detecting the steady state, or the transient state is calculated to select one of the fuel weights $\beta_1$ to $\beta_4$. For example, in a transient state such as at the start of acceleration or at rapid deceleration of the vehicle, the small weight $\beta_4$ is selected. Thus, when the weighted mean is obtained in accordance with $$Gf = (1/\beta)Gfn + \{(\beta - 1)/\beta\}Gfo,$$

the fuel injection quantity Gf is calculated based mainly on the present fuel injection quantity Gfn. As a result, the fuel injection quantity is increased without causing response delay.

As the difference $\Delta\theta$ decreases so as to proceed to the steady state, the weight increases to $\beta_3$, $\beta_2$ and $\beta_1$, thereby weighting the last calculated fuel injection quantity Gfo. Consequently, even though the intake air quantity signal Q and the crank angle signal include disturbing noises, the smoothed fuel injection quantity Gf does not deviate much. Accordingly, the oscillation of the fuel injection quantity is restrained to provide stable driving in the steady state.

Although the fuel weight $\beta$, which corresponds to the load on the engine, is obtained in the weight providing section 32 dependent on the change in throttle valve opening degree $\theta$, the present embodiment may be modified to obtain the fuel weight $\beta$ dependent on the change in engine speed Ne. In this case, the fuel weight is increased with a decrease of the changing degree of the engine speed.

In accordance with the present invention, the quantity of fuel to be injected which is calculated based on various factors is smoothed by obtaining the weighted mean between the fuel injection quantity calculated at the present add the smoothed fuel injection quantity at the previous calculations. In a steady state, the previous quantity is stressed so as to restrain fluctuation of the fuel injecting quantity caused by disturbing noise. In a transient state, the present quantity is stressed to improve the respondability of the fuel injection system. In addition, the smoothed fuel injection quantity can be easily controlled by varying the weight in dependency on driving conditions.

While the presently preferred embodiment of the present invention has been shown and described, it is to be understood that this disclosure is for the purpose of illustration and that various changes and modifications may be made without departing from scope of the invention as set forth in the appended claims.

What is claimed is:

1. In a fuel injection control system of an engine having an intake passage for inducing an air and fuel mixture into a cylinder of the engine, a fuel injector provided in said intake passage for injecting an amount of fuel, a throttle valve interposed between said injector and said cylinder for controlling power of said engine, an air flow meter inserted in said intake passage for detecting air flow induced into said cylinder and for producing an air flow signal, a coolant temperature sensor for detecting temperature of said engine and for producing a temperature signal, an engine speed sensor for detecting engine speed and for producing an engine speed signal and a throttle position sensor for detecting opening degree of said throttle valve and for producing a throttle signal, the improvement of the system which comprises:

desired air-fuel ratio calculating means responsive to said temperature signal for calculating a desired air-fuel ratio corresponding to each operating condition of said engine and for producing a desired air-fuel ratio signal;

fuel adhesion rate providing means responsive to said throttle signal and said temperature signal for calculating a fuel adhesion rate of adhered fuel in said intake passage and for generating an adhesion rate signal;

air flow weight providing means responsive to said throttle and said engine speed signals for providing an air flow weight to correct said air flow and for producing an air flow weight signal;

intake air quantity smoothing means responsive to said weight and said air flow signals for computing an air quantity required for said each operating condition of said engine and for producing an air quantity signal;

evaporation constant calculating means responsive to said throttle, said air quantity and said engine speed signals for calculating an evaporation time constant of said fuel in said intake passage and for providing a time constant signal;

adhering fuel calculating means responsive to said adhesion rate and said time constant signals for calculating an adhered fuel amount in said intake passage and for producing an adhered fuel amount signal;

a fuel injection quantity calculator responsive to said adhesion rate, said adhered fuel amount, said time constant and said quantity signals for calculating a fuel injection quantity in conformity with said each operating condition of said engine and for producing a fuel injection quantity signal;

a fuel weight providing section responsive to said throttle signal for computing a fuel weight corresponding to a difference of said throttle signal within a predetermined time and for generating a fuel weight signal;

a fuel injection quantity smoothing section responsive to said fuel injection quantity signal and said fuel weight signal for smoothing said fuel injection quantity signal in dependency on said difference and for generating a smoothed fuel injection quantity signal so as to restrain fluctuation of said fuel injection quantity caused by noise disturbance; and a fuel injection pulse calculator responsive to said smoothed fuel injection quantity signal for calculating a fuel injection pulse to inject said fuel from said injector so as to be easily controlled by varying said fuel weight at any driving condition.

2. The fuel injection control system according to claim 1, wherein said fuel weight increases inversely proportional to said opening degree of said throttle valve.

3. In a fuel injection control system of an engine having an intake passage for inducing an air and fuel mixture into a cylinder of the engine, a fuel injector provided in said intake passage for injecting an amount of fuel, a throttle valve interposed between said injector and said cylinder for controlling power of said engine, an air flow meter inserted in said intake passage for detecting air flow induced into said cylinder and for producing an air flow signal, a coolant temperature sensor for detecting temperature of said engine and for producing a temperature signal, an engine speed sensor for detecting engine speed and for producing an engine speed signal, and a throttle position sensor for detecting opening degree of said throttle valve and for producing a throttle signal, the improvement of the system which comprises:

desired air-fuel ratio calculating means responsive to said temperature signal for calculating a desired air-fuel ratio corresponding to each operating condition of said engine and for producing a desired air-fuel ratio signal;

fuel adhesion rate providing means responsive to said throttle signal and said temperature signal for calculating a fuel adhesion rate of adhered fuel in said intake passage and for generating an adhesion rate signal;

air flow weight providing means responsive to said throttle and said engine speed signals for providing an air flow weight to correct said air flow and for producing an air flow weight signal;

intake air quantity smoothing means responsive to said weight and said air flow signals for computing an air quantity required for said each operating condition of said engine and for producing an air quantity signal;

evaporation constant calculating means responsive to said throttle, said air quantity and said engine speed signals for calculating an evaporation time constant of said fuel in said intake passage and for providing a time constant signal;

adhering fuel calculating means responsive to said adhesion rate and said time constant signals for calculating an adhered fuel amount in said intake passage and for producing an adhered fuel amount signal;

a fuel injection quantity calculator responsive to said adhesion rate, said adhered fuel amount, said time constant and said quantity signals for calculating a fuel injection quantity in conformity with said each operating condition of said engine and for producing a fuel injection quantity signal;

a fuel weight providing section responsive to said engine speed for computing a fuel weight corresponding to a difference of said engine speed signal within a predetermined time and for generating a fuel weight signal;

a fuel injection quantity smoothing section responsive to said fuel injection quantity signal and said fuel weight signal for smoothing said fuel injection quantity signal in dependency on said difference and for generating a smoothed fuel injection quantity signal so as to restrain fluctuation of said fuel injection quantity caused by noise disturbance; and a fuel injection pulse calculator responsive to said smoothed fuel injection quantity signal for calculating a fuel injection pulse to inject said fuel from said injector so as to be easily controlled by varying said fuel weight at any driving condition.

4. The fuel injection control system according to claim 3, wherein said fuel weight increases inversely proportional to said engine speed.

5. A fuel injection control method of an engine having an intake passage for inducing an air and fuel mixture into a cylinder of an engine, a fuel injector provided in said intake passage for injecting an amount of fuel, a throttle valve interposed between said injector and said cylinder for controlling power of said engine, an air flow meter inserted in said intake passage for detecting air flow induced into said cylinder and for producing an air flow signal, a coolant temperature sensor for detecting temperature of said engine and for producing a temperature signal, an engine speed sensor for detecting engine speed and for producing an engine speed signal, and a throttle position sensor for detecting opening degree of said throttle valve and for producing a throttle signal, the method comprising the steps of:

calculating a desired air-fuel ratio corresponding to each operating condition of said engine from said temperature signal;

computing a fuel adhesion rate of adhered fuel in said intake passage from said throttle signal and said temperature signal;

providing an air flow weight to correct said air flow from said throttle and said engine speed signals;

deriving an air quantity required for said each operating condition of said engine form said air flow weight and said air flow signals;

producing an evaporation time constant of said fuel in said intake passage from said throttle, said air quantity and said engine speed signals;

generating an adhered fuel amount signal in said intake passage from said adhesion rate and said time constant;

outputting a fuel injection quantity signal representing a fuel injection quantity in conformity with said each operating condition of said engine from said adhesion rate, said adhered fuel amount, said time constant and said quantity signals;

providing a fuel weight to smooth said fuel injection quantity signal from a difference of said throttle signal within a predetermined time;

smoothing said fuel injection quantity signal by said fuel weight in dependency on said difference for obtaining a smoothed fuel injection quantity so as to restrain fluctuation of said fuel injection quantity caused by noise disturbance; and injecting said fuel from said injector in accordance with said smoothed fuel injection quantity so as to be easily controlled by varying said fuel weight an any driving condition.

6. The fuel injection control method according to claim 5, wherein said step of providing said fuel weight is performed by increasing said fuel weight inversely proportional to said opening degree of said throttle valve.

7. A fuel injection control method of an engine having an intake passage for inducing an air and fuel mixture into a cylinder of the engine, a fuel injector provided in said intake passage for injecting an amount of fuel, a throttle valve interposed between said injector and said cylinder for controlling power of said engine, an air flow meter inserted in said intake passage for detecting air flow induced into said cylinder and for producing an air flow signal, a coolant temperature sensor for detecting temperature of said engine and for producing a temperature signal, an engine speed sensor for detecting engine speed and for producing an engine speed signal, and a throttle position sensor for detecting opening degree of said throttle valve and for producing a throttle signal, the method comprising the steps of:

calculating a desired air-fuel ratio corresponding to each operating condition of said engine from said temperature signal;

computing a fuel adhesion rate of adhered fuel in said intake passage from said throttle signal and said temperature signal;

providing an air flow weight to correct said air flow from said throttle and said engine speed signals;

deriving an air quantity required for said each operating condition of said engine from said air flow weight and said air flow signals;

producing an evaporation time constant of said fuel in said intake passage from said throttle, said air quantity and said engine speed signals;

generating an adhered fuel amount in said intake passage from said adhesion rate and said time constant;

outputting a fuel injection quantity signal representing a fuel injection quantity in conformity with said each operating condition of said engine from said adhesion rate, said adhered fuel amount, said time constant and said quantity signals;

providing a fuel weight to smooth said fuel injection quantity signal from a difference of said engine speed signal within a predetermined time;

smoothing said fuel injection quantity signal by said fuel weight in dependency on said difference for obtaining a smoothed fuel injection quantity so as to restrain fluctuation of said fuel injection quantity caused by noise disturbance; and injecting said fuel from said injector in accordance with said smoothed fuel injection quantity so as to be easily controlled by varying said fuel weight at any driving condition.

8. The fuel injection control method according to claim 7, wherein said step of providing said fuel weight is performed by increasing said fuel weight inversely proportional to said engine speed.

* * * * *